US010125969B2

(12) United States Patent
Welfare

(10) Patent No.: US 10,125,969 B2
(45) Date of Patent: Nov. 13, 2018

(54) HOLIDAY WINDOW LIGHT

(71) Applicant: EPLS, LLC, Lynchburg, VA (US)

(72) Inventor: Laura E. Welfare, Lynchburg, VA (US)

(73) Assignee: EPLS, LLC, Lynchburg, VA (US)

( * ) Notice: Subject to any disclaimer, the term of this patent is extended or adjusted under 35 U.S.C. 154(b) by 36 days.

(21) Appl. No.: 15/454,323

(22) Filed: Mar. 9, 2017

(65) Prior Publication Data

US 2018/0259175 A1 Sep. 13, 2018

(51) Int. Cl.

| | |
|---|---|
| ***F21V 33/00*** | (2006.01) |
| ***F21V 21/08*** | (2006.01) |
| ***F21S 8/00*** | (2006.01) |
| ***E06B 7/28*** | (2006.01) |
| *F21W 121/00* | (2006.01) |

(52) U.S. Cl.
CPC ..... *F21V 33/006* (2013.01); *E06B 7/28* (2013.01); *F21S 8/03* (2013.01); *F21V 21/0808* (2013.01); *F21W 2121/00* (2013.01)

(58) Field of Classification Search
CPC .... F21V 33/006; F21V 21/0808; F21V 17/10; F21V 17/102; F21V 19/00; F21V 19/02; F21V 21/00; F21V 21/08; F21V 21/092; F21V 21/0925; F21S 8/03; F21W 2121/00; E06B 7/28
See application file for complete search history.

(56) References Cited

U.S. PATENT DOCUMENTS

| | | | | |
|---|---|---|---|---|
| 1,739,641 | A * | 12/1929 | Lessmann | B60Q 1/24 248/206.2 |
| 5,311,417 | A * | 5/1994 | Heh | A47G 33/00 362/249.11 |
| 6,648,492 | B1 * | 11/2003 | Shih | F21V 21/092 362/249.01 |
| 2005/0201084 | A1 * | 9/2005 | Huang | B60Q 1/2615 362/157 |
| 2009/0103317 | A1 * | 4/2009 | Steck | F21S 9/02 362/397 |
| 2016/0300514 | A1 * | 10/2016 | Quinones Vazquez | F21S 4/20 |

* cited by examiner

*Primary Examiner* — Bao Q Truong
(74) *Attorney, Agent, or Firm* — James G. Passé; Passé Intellectual Property, LLC

(57) ABSTRACT

The invention relates to a light for attaching to the inside of a surface of the glass in a window. The device is adopted with a seal against the window to prevent light leaks or reflected light into the room.

3 Claims, 2 Drawing Sheets

HOLIDAY WINDOW LIGHT

COPYRIGHT NOTICE

A portion of the disclosure of this patent contains material that is subject to copyright protection. The copyright owner has no objection to the reproduction by anyone of the patent document or the patent disclosure as it appears in the Patent and Trademark Office patent files or records, but otherwise reserves all copyright rights whatsoever.

BACKGROUND OF THE INVENTION

Field of the Invention

The present invention relates to a light designed for holiday placement in a window. In particular, it relates to a light that can shine outward from a window and reflects or leaks little or no light back into the room.

Description of Related Art

The use of a candle or other light in one or more window of the house at holiday time dates back to the 1800's or earlier in the United States and other countries. With the problems associated with having a lit fire in the window, early on, limited numbers of people utilized this decorative feature and frequently limited it to one window.

With the advent of electricity, it became safer to place not only a light in one window but every available window. As AC current made way for battery operated candles, the use of candles in the window have become widespread in the Unites States.

However, a problem with any light in the window device is the light shines into the house as well as to the exterior. In addition, interior surface of window glass is highly reflective and much of light that could reach the outside is reflected back into the room. That means rooms with lights in the windows are never dark which can lead to sleep problems and other inconveniences caused by the unwanted room light, especially in a bedroom window. While light timers can get the lights off at a certain time, it does mean that the lights can not be left on all night and if a person's schedule changes, the times in each window need to be reset. Clearly, there is room for improvement in these types of lights.

BRIEF SUMMARY OF THE INVENTION

The present invention relates to a light for use in an interior room window which seals up against the window and minimizes or eliminates reflected and leaked light back into the room.

In one embodiment, there is a light for use in a room on a window glass having an inward facing side comprising:

a) one or more lightbulb powered by an AC or DC electrical source;
b) a housing for containing the powered one or more lightbulb;
c) a device for attaching the housing to the inward facing side of the window glass such that the one or more light bulbs is facing the window glass; and
d) a seal on the housing that creates a seal between the housing and the window glass that reduces or eliminates light in the room from the light.

DETAILED DESCRIPTION OF THE INVENTION

Figure 1:
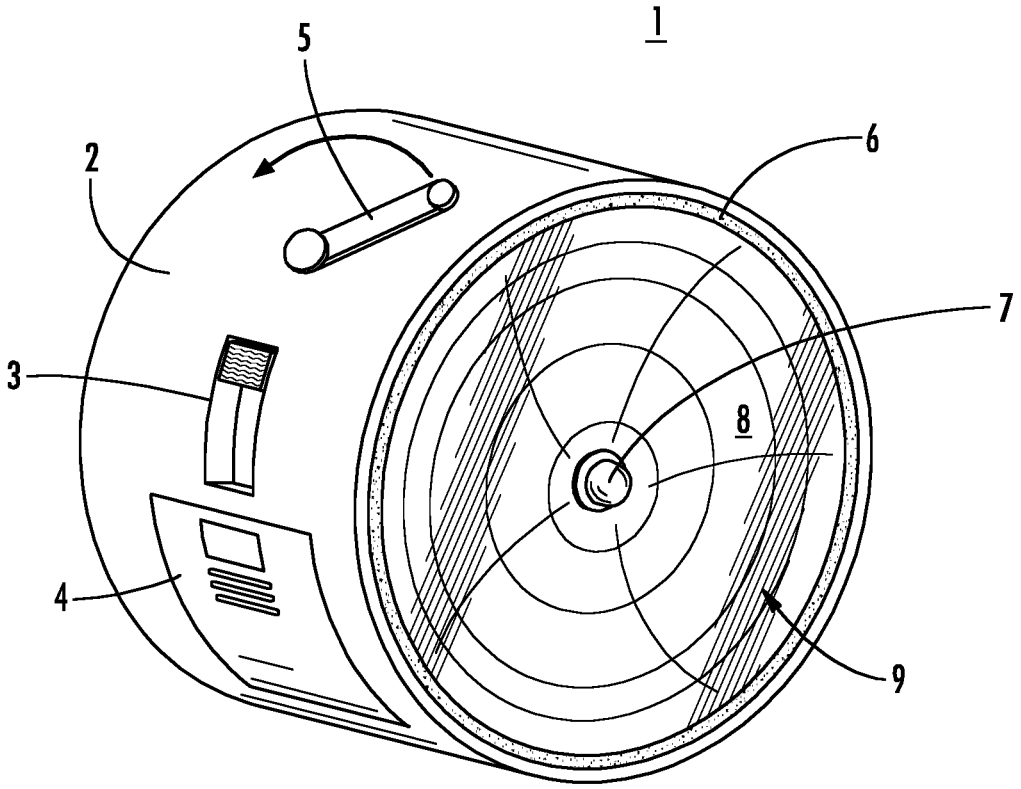
FIG. 1 is a frontal perspective view of the light of the present invention.

While this invention is susceptible to embodiment in many different forms, there is shown in the drawings and will herein be described in detail specific embodiments, with the understanding that the present disclosure of such embodiments is to be considered as an example of the principles and not intended to limit the invention to the specific embodiments shown and described. In the description below, like reference numerals are used to describe the same, similar or corresponding parts in the several views of the drawings. This detailed description defines the meaning of the terms used herein and specifically describes embodiments in order for those skilled in the art to practice the invention.

Definitions

The terms "about" and "essentially" mean ±10 percent.

The terms "a" or "an", as used herein, are defined as one or as more than one. The term "plurality", as used herein, is defined as two or as more than two. The term "another", as used herein, is defined as at least a second or more. The terms "including" and/or "having", as used herein, are defined as comprising (i.e., open language). The term "coupled", as used herein, is defined as connected, although not necessarily directly, and not necessarily mechanically.

The term "comprising" is not intended to limit inventions to only claiming the present invention with such comprising language. Any invention using the term comprising could be separated into one or more claims using "consisting" or "consisting of" claim language and is so intended.

Reference throughout this document to "one embodiment", "certain embodiments", and "an embodiment" or similar terms means that a particular feature, structure, or characteristic described in connection with the embodiment is included in at least one embodiment of the present invention. Thus, the appearances of such phrases or in various places throughout this specification are not necessarily all referring to the same embodiment. Furthermore, the particular features, structures, or characteristics may be combined in any suitable manner in one or more embodiments without limitation.

The term "or" as used herein is to be interpreted as an inclusive or meaning any one or any combination. Therefore, "A, B or C" means any of the following: "A; B; C; A and B; A and C; B and C; A, B and C". An exception to this definition will occur only when a combination of elements, functions, steps or acts are in some way inherently mutually exclusive.

The drawings featured in the figures are for the purpose of illustrating certain convenient embodiments of the present invention, and are not to be considered as limitation thereto. Term "means" preceding a present participle of an operation indicates a desired function for which there is one or more embodiments, i.e., one or more methods, devices, or apparatuses for achieving the desired function and that one skilled in the art could select from these or their equivalent in view of the disclosure herein and use of the term "means" is not intended to be limiting.

As used herein the term "light" refers to a flashlight type device (often called a torch outside North America) which is a portable hand-held electric light designed for using stationary in a particular place, specifically to shine out through a window glass. The source of the light is an incandescent light bulb or light-emitting diode (LED) or the like. It consists of a light bulb mounted in an optional reflector, an optional transparent cover (which could be combined with a focusing lens) to protect the light source and reflector, a battery (disposable or rechargeable), or AC connect, and a switch. These are supported and protected by a housing, in one embodiment, opaque looking. In particular, it also has a device for attaching the housing to the inward facing side (inside the house) of the window glass such that the light bulb is facing the window glass and shines toward the outside. It also has a seal on the housing that creates a light tight seal between the housing and the window glass in a manner that reduces or eliminates light reflection from the inner facing side of the glass as well as light leaking into the room.

As used herein the term "window glass" refers to the transparent or semi-transparent glass inserted in the window frame of an apartment, a house or other building.

As used herein the term "lightbulb" refers to an incandescent or LED or other bulb usable in a small portable light.

As used herein the term "electrical source" refers to DC batteries or AC electrical connection. In one embodiment, the batteries are inside the housing and the light can be turned on by a switch.

As used herein the term "housing" refers to an opaque or semi-opaque container for holding the batteries and the light bulb. It can also include a reflector for behind the lightbulb. In one embodiment, there is a lens or a transparent cover, or both, over the bulb. The housing can be any shape, though in one embodiment, the housing is cylindrical as shown in the drawings.

As used herein the term "device for attaching" refers to a device which attaches the housing, e.g. the transparent cover against the inside of a window glass for shining outwardly. A suction device, an adhesive, magnets on either side of the window, or the like are contemplated within the invention.

As used herein the term "facing window glass" refers to the window having glass with one surface on the inside of the building and one on the outside of the building. The inward facing side on the inside of the building is where the device of the invention is attached facing outward so the light shines out of the house. A seal prevents light from leaking back into the house or reflecting off the inward side of the glass and back into the house.

As used herein the term "seal" refers to a gasket, adhesive, suction, polymeric seal or the like positioned around an edge of the housing to prevent light from leaking from or reflecting back into the room. By positioning it, as shown in the figures, around the lens or transparent glass when the device is up against the glass pane, it creates a light tight or at least greatly light reduced seal. One viewing the drawings can see an embodiment but such is not so limited to that single embodiment.

DRAWINGS

Now referring to the drawings, FIG. 1 is a perspective frontal view of the device of the present invention. Window light 1 consists of opaque cylindrical housing 2, on/off switch 3, battery compartment 4, suction switch 5 which can instead use adhesive ring 6, or both, to attach to the window glass. Light bulb 7 (LED) is positioned on the window facing side of device with a reflector 8 behind the lightbulb 7 and a transparent light cover 9.

Figure 2:
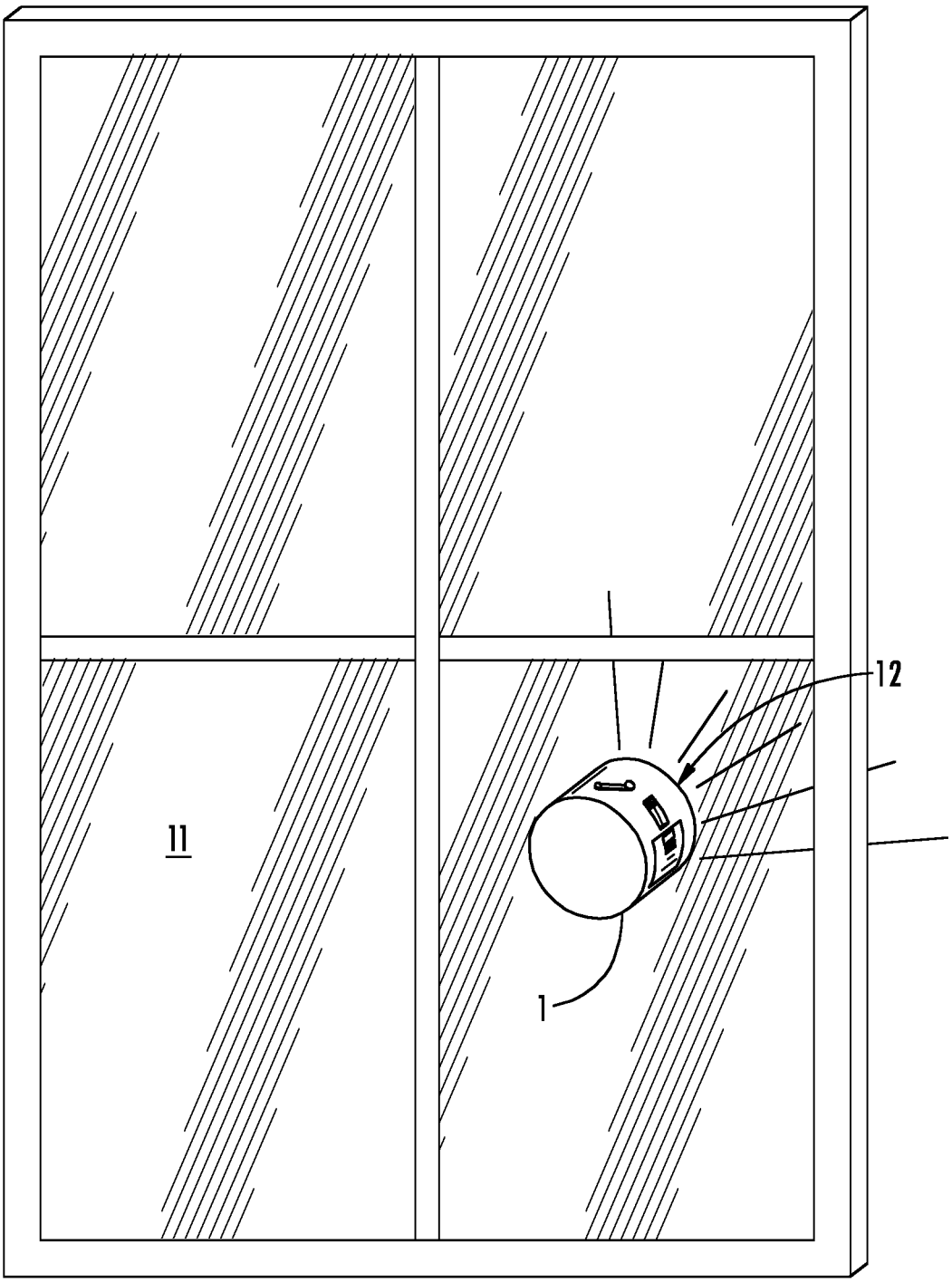
FIG. 2 is a perspective view of the light mounted on the interior surface of the glass in a window.

FIG. 2 shows a perspective of the device 1 mounted on the inward surface of a window 11 sealed 12 so that only light goes out of the house/window 11 and not back into the house.

Those skilled in the art to which the present invention pertains may make modifications resulting in other embodiments employing principles of the present invention without departing from its spirit or characteristics, particularly upon considering the foregoing teachings. Accordingly, the described embodiments are to be considered in all respects only as illustrative, and not restrictive, and the scope of the present invention is, therefore, indicated by the appended claims rather than by the foregoing description or drawings. Consequently, while the present invention has been described with reference to particular embodiments, modifications of structure, sequence, materials and the like apparent to those skilled in the art still fall within the scope of the invention as claimed by the applicant.

What is claimed is:

1. An indoor single holiday light mounted on an inward facing side of an outward facing window glass of a window in a room, the single light comprising:

a) one or more lightbulb designed to be used in a small flashlight powered by an AC or DC electrical source;

b) an opaque housing for containing the powered one or more lightbulb;

c) an adhesive or polymeric seal attaching the housing to the inward facing side of the window glass such that the one or more lightbulb is facing the window glass such that the light can be seen from a position outside the room and looking at the window;

d) wherein the adhesive or polymeric seal creates a seal between the housing and the window glass that reduces or eliminates light in the room from the one or more lightbulb; and e) a reflector behind the one or more lightbulb and wherein the single light is not connected directly to any other light and there is only one light per window.

2. The light according to claim 1 which is DC powered.

3. The light according to claim 1 wherein the housing is cylindrical.

* * * * *